US011142966B2

(12) United States Patent
Burke et al.

(10) Patent No.: US 11,142,966 B2
(45) Date of Patent: Oct. 12, 2021

(54) STOWING SUPPORT EQUIPMENT FOR A CATWALK

(71) Applicant: Nabors Drilling Technologies USA, Inc., Houston, TX (US)

(72) Inventors: Travis Burke, Spring, TX (US); Victor Martinez, Spring, TX (US); Jane Towns, Houston, TX (US)

(73) Assignee: Nabors Drilling Technologies USA, Inc., Houston, TX (US)

( * ) Notice: Subject to any disclaimer, the term of this patent is extended or adjusted under 35 U.S.C. 154(b) by 0 days.

(21) Appl. No.: 17/122,544

(22) Filed: Dec. 15, 2020

(65) Prior Publication Data

US 2021/0198959 A1 Jul. 1, 2021

Related U.S. Application Data

(60) Provisional application No. 62/954,781, filed on Dec. 30, 2019.

(51) Int. Cl.
*E21B 19/15* (2006.01)
*E21B 19/24* (2006.01)

(52) U.S. Cl.
CPC ..... *E21B 19/155* (2013.01); *E21B 19/24* (2013.01)

(58) Field of Classification Search
CPC .... E21B 19/155; E21B 19/24; Y10S 414/131; F16G 13/16
USPC ..... 414/22.51–22.71
See application file for complete search history.

(56) References Cited

U.S. PATENT DOCUMENTS

2006/0104746 A1* 5/2006 Thompson ..... E21B 19/155 414/22.54
2013/0277508 A1* 10/2013 Trevithick ..... H02G 3/263 248/49
2014/0224944 A1* 8/2014 Royer ..... E21B 15/003 248/70
2015/0096952 A1* 4/2015 Hall ..... E21B 15/003 211/132.1

* cited by examiner

*Primary Examiner* — Lynn E Schwenning
(74) *Attorney, Agent, or Firm* — Abel Schillinger, LLP; Enrique Abarca

(57) ABSTRACT

A pipe handling system that can include a base skid, a ramp rotationally attached to the base skid, and support equipment (e.g., a drag chain pan, or equipment skid) coupled to the ramp, wherein rotation of the ramp from a first deployed position to a first stowed position lifts the support equipment from a second deployed position to a second stowed position. A method can include rotating the ramp relative to the base skid from a first deployed position to a first stowed position, and simultaneously lifting support equipment relative to the base skid from a second deployed position to a second stowed position in response to rotating the ramp.

20 Claims, 11 Drawing Sheets

STOWING SUPPORT EQUIPMENT FOR A CATWALK

CROSS-REFERENCE TO RELATED APPLICATION(S)

This application claims priority under 35 U.S.C. § 119(e) to U.S. Patent Application No. 62/954,781, entitled "STOWING SUPPORT EQUIPMENT FOR A CATWALK," by Travis BURKE et al., filed Dec. 30, 2019, which application is assigned to the current assignee hereof and incorporated herein by reference in its entirety.

TECHNICAL FIELD

The present invention relates, in general, to the field of drilling and processing of wells. More particularly, present embodiments relate to a system and method for managing a drag chain pan of a catwalk during subterranean operations.

BACKGROUND

Catwalks can have a carrier that lifts tubulars from a horizontal storage location through a V-door to the drill floor. The carrier is liftable from a base skid of the catwalk to deliver the tubulars to the drill floor. To lift the carrier (or at least one end of the carrier), cables can be used to pull one end of the carrier up a ramp of the catwalk. As the cables pull the carrier, the carrier slides through an upwardly opening recess in base skid. Control and power lines required to operate the carrier are slide along the recess as well. Control and power lines have a large service loop to allow for sliding the carrier in the recess. When the carrier is lifted to the V-door, the service loop can be extended beyond an end of the catwalk base skid. The service loop can be enclosed in an articulating drag chain that protects the control and power lines while the drag chain is slid along the recess with the base skid. As the drag chain extends past the end of the base skid, there should be a support for the drag chain as it extends and retracts from the base skid end. A drag chain pan can provide this support, where the drag chain can extend from the end of the base skid into the drag chain pan, and the drag chain pan supports the drag chain.

These drag chain pans can be fairly long as they have to accommodate the amount of drag chain that can be extended from the end of the base skid. Many catwalks are used at several different well sites. These catwalks are packed up for shipping and redeployed at the new well site. For example, the carrier is lowered into the upwardly opening recess of the base skid, and the ramp is folded over on top of the base skid to rest against the base skid during transport. The drag chain pan is stowed in such a way as to lift it off of the ground and minimize required clearances at the end of the base skid for transport. Some drag chain pans have been designed to fold in half, to reduce length when stowed, and pivot up toward the base skid to be secured for transport. However, this folding design of the drag chain pan causes the weight of the drag chain pan to require a piece of handling equipment (e.g., forklift, wench, etc.) to lift and stow the drag chain pan for transport as well as deploy the drag chain pan at the new well site. Therefore, improvements in catwalk systems are continually needed.

SUMMARY

In accordance with an aspect of the disclosure, a system for conducting subterranean operations that can include a pipe handling system configured to transport tubulars between a horizontal storage location and a rig floor of a rig, the pipe handling system that can include a base skid, a ramp rotationally attached to the base skid, and support equipment positioned proximate the rotational attachment of the ramp to the base skid, where rotation of the ramp from a first deployed position to a first stowed position can lift the support equipment from a second deployed position to a second stowed position.

In accordance with an aspect of the disclosure, a system for conducting subterranean operations that can include a pipe handling system configured to transport tubulars between a horizontal storage location and a rig floor of a rig, the pipe handling system that can include a base skid, a ramp rotationally attached to the base skid, and a drag chain pan rotationally attached to the base skid at pivot points and the drag chain pan coupled to the ramp, where rotation of the ramp from a first deployed position to a first stowed position can rotate the drag chain pan from a second deployed position to a second stowed position.

In accordance with another aspect of the disclosure, a method for conducting subterranean operations can include operations of moving a pipe handling system, where the pipe handling system can include a ramp rotationally attached to a base skid, and a drag chain pan rotationally attached to the base skid, rotating the ramp relative to the base skid from a first deployed position to a first stowed position, and simultaneously rotating the drag chain pan relative to the base skid from a second deployed position to a second stowed position in response to rotating the ramp from the first deployed position to the first stowed position.

BRIEF DESCRIPTION OF THE DRAWINGS

These and other features, aspects, and advantages of present embodiments will become better understood when the following detailed description is read with reference to the accompanying drawings in which like characters represent like parts throughout the drawings, wherein.

DETAILED DESCRIPTION

The following description in combination with the figures is provided to assist in understanding the teachings disclosed herein. The following discussion will focus on specific implementations and embodiments of the teachings. This focus is provided to assist in describing the teachings and should not be interpreted as a limitation on the scope or applicability of the teachings.

As used herein, the terms "comprises," "comprising," "includes," "including," "has," "having," or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

The use of "a" or "an" is employed to describe elements and components described herein. This is done merely for convenience and to give a general sense of the scope of the invention. This description should be read to include one or at least one and the singular also includes the plural, or vice versa, unless it is clear that it is meant otherwise.

The use of the word "about", "approximately", or "substantially" is intended to mean that a value of a parameter is close to a stated value or position. However, minor differences may prevent the values or positions from being exactly as stated. Thus, differences of up to ten percent (10%) for the value are reasonable differences from the ideal goal of exactly as described. A significant difference can be when the difference is greater than ten percent (10%).

Figure 1:
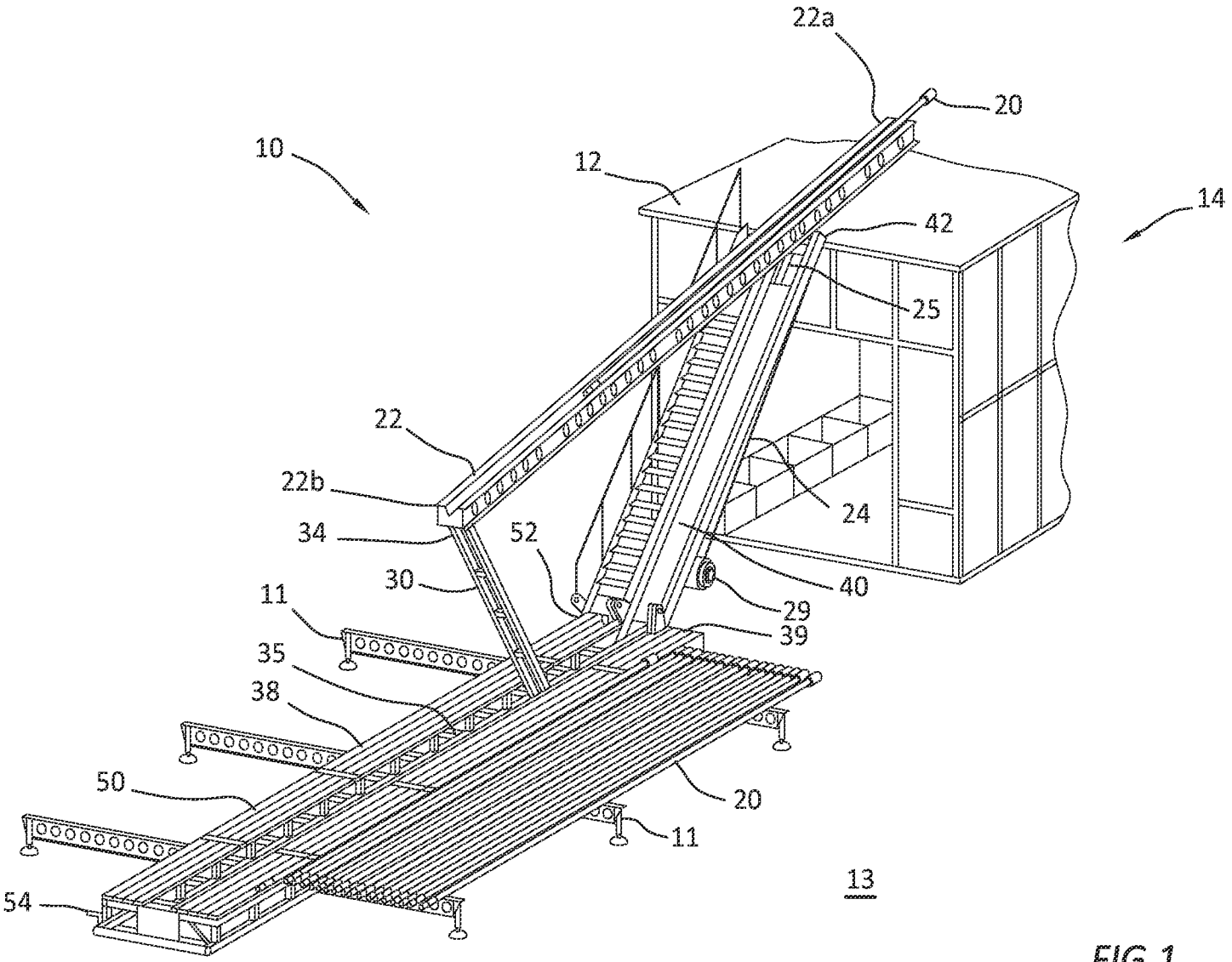
FIG. 1 is a representative perspective view of a pipe handling system installed adjacent a rig, in accordance with certain embodiments.

FIG. 1 shows a pipe-handling system 10 for conveying pipe from a ground-supported pipe rack 11 onto the drill floor 12 of a rig 14. The pipe-handling system 10 can include a ramp 40 and a base skid 50 that may include one or more catwalks 38, 39 and a moveable pipe carrier 22. The base skid 50 may be mounted on a ground surface 13 and the ramp 40 can transition between an end of the base skid 50 and the floor 12 of the rig 14. Pipe racks 11 can be positioned adjacent the base skid 50 to hold a supply of tubulars 20. Tubulars 20 can be passed between the rig 14 and the pipe racks by pipe carrier 22. As used herein, "tubular" refer to an elongated tubular with threaded ends, which can include a single tubular segment with threaded ends or a tubular stand that contains two or more tubular segments that are connected together by threaded joints. Other rig equipment can be passed up and down the ramp 40, such as a bottom hole assembly (BHA), rig floor equipment, and other tool assemblies.

Pipe-handling system 10 includes a drive system for moving the pipe carrier 22 between a lowered position to an elevated position, with the elevated position being shown in FIG. 1. In the following discussion, the term "ramp end" (indicated by 22*a*) is the end of the pipe carrier 22 adjacent the ramp 40, while the "far end" (indicated by 22*b*) of the pipe carrier 22 is the end opposite to the ramp end 22*a*. In the illustrated embodiment, the drive system may be based on a cable-drive including, for example, a winch 29 that may provide high-speed operation. Spaced-apart cables 24 can be roved about upper sheaves 25 and attached between the pipe carrier 22 and the winch 29.

The drive system can include a carrier elevation assembly that can include a lift arm 30 that is journaled at end 34 which is adjacent the far end of the pipe carrier 22. The pipe carrier 22 and lift arm 30 can ride along an upwardly opening recess 35 in the base skid 50 during elevating and lowering of the pipe carrier 22. The recess 35 can extend axially along the long axis of the base skid 50 and provides a support surface so that the assembly of the carrier 22 and the lift arm 30 can move along the track toward and away from the ramp 40.

The recess 35 may be longitudinally extending in the base skid 50 to accommodate the pipe carrier 22 with an upper surface of the pipe carrier substantially flush with catwalks 38, 39 when the pipe carrier 22 is in the lowered position (i.e., disposed in the recess 35). Ramp 40 is formed to accept and support the ramp end 22*a* of carrier 22 as it moves thereover between its lowered and elevated positions relative to the rig floor 12. Ramp 40 further includes an upper end 42 including a bearing surface capable of supporting movement of the pipe carrier 22 thereover. The ramp end 22*a* of pipe carrier 22 can include opposed rollers that can ride in tracks of the ramp 40. An underside of the pipe carrier 22 can be formed to ride over the upper end 42, when the rollers exit the upper end of the tracks, thus allowing further extension of the carrier 22 over the drill floor 12.

Figure 2:
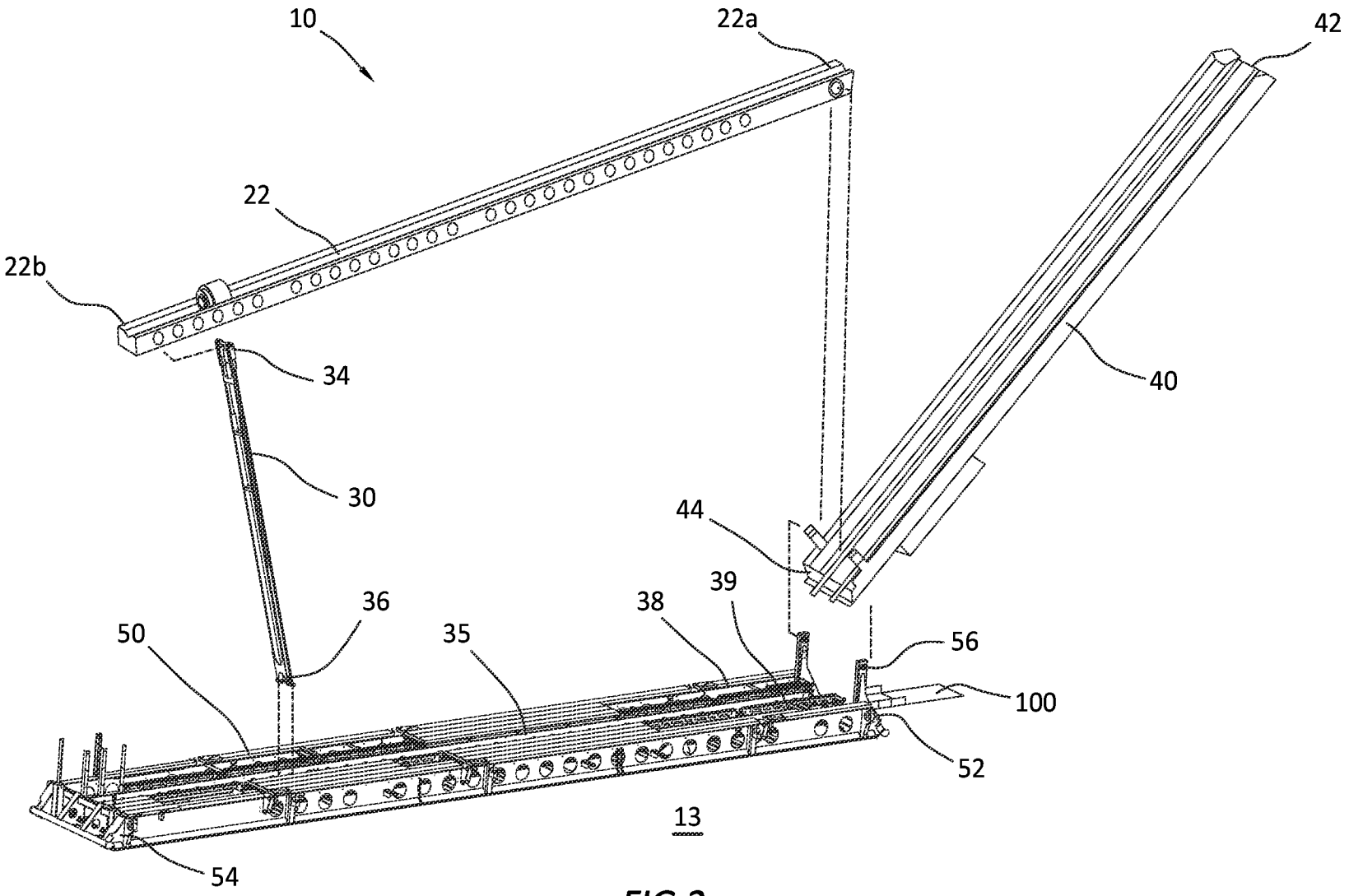
FIG. 2 is a representative exploded view of a pipe handling system, in accordance with certain embodiments.

FIG. 2 is a perspective view of a pipe-handling system 10. The base skid 50 can be positioned on a surface of the ground 13 and the base skid 50 can include opposite ends 52, 54, with end 54 being farthest from the rig 14 (see FIG. 1). The end 52 can be rotationally attached to the end 44 of the ramp 40 at pivot point 56. The end 42 of the ramp 40 can be positioned just above a rig floor 12 to facilitate delivery of tubulars from the pipe handling system 10 to the rig floor 12.

In operation, the carrier 22 can receive tubulars 20 from a horizontal storage location. In this position, the carrier 22 can be positioned in the recess 35 of the base skid 50 with the lift arm 30 folded up underneath the carrier 22 and also in the recess 35. As cables pull the ramp end 22*a* of the carrier 22 toward the rig floor 12, the ramp end 22*a* engages the ramp 40 at the end 44 and begins traveling up the ramp 40 as the cables continue to pull the carrier 22. The lift arm 30, which is rotationally mounted proximate the far end 22*b* at its end 34, slides along with the far end 22*b* until the lift arm end 36 engages a stop in the base skid 50. Control and power lines used to operate the carrier 22 can be routed along the lift arm 30 to the carrier 22. The control and power lines include a service loop that allows the control and power lines to accommodate the movement of the lift arm 30 in the recess 35. The control and power lines can be enclosed in an articulating cable carrier, which can be referred to as a drag chain. When the lift arm 30 is moved toward the ramp 40, then the excess of the service loop enclosed in the drag chain can be extended from the base skid 50 into the drag chain pan 100. When the lift arm end 36 engages the stop, then the lift arm 30 can begin to rotate the lift arm end 34 out of the recess 35, thereby lifting the far end 22*b* out of the recess and lifting the carrier 22.

As the cables 24 continue to pull the carrier 22 toward the ramp end 42 of the ramp 40, the lift arm 30 can continue to lift the far end 22*b*, while the cables 24 pull the ramp end 22*a* of the carrier along the ramp 40 toward the ramp end 42 of the ramp 40. When the ramp end 22*a* of the carrier reaches the ramp end 42 of the ramp 40, the ramp end 22*a* of the carrier can extend over the ramp end 42 of the ramp 40 and further onto the rig floor 12.

Figure 3:
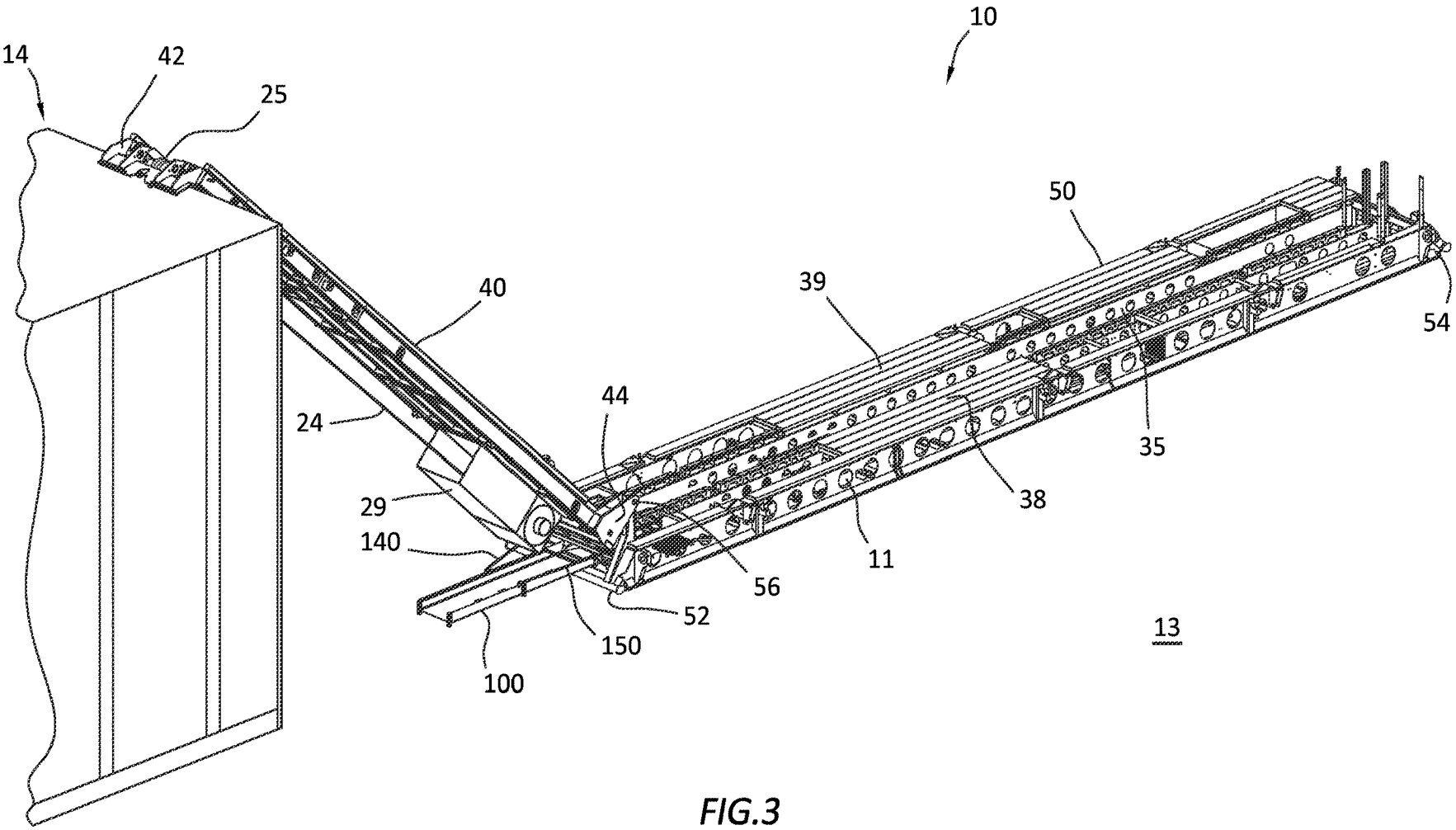
FIG. 3 is a representative perspective view of a pipe handling system installed adjacent a rig, in accordance with certain embodiments.

FIG. 3 is a representative perspective view of a pipe handling system installed adjacent a rig. The pipe racks 11 have been folded against the side of the base skid 50. Cables 140, 150 can be connected between the ramp end 44 and pad eyes on the drag chain pan 100. This allows the drag chain pan 100 to be lifted when the ramp 40 is rotated to a stowed position and resting on the base skid 50. It should also be understood that other support equipment 100 (i.e., other than a drag chain pan) can be lifted to a stowed position by the ramp 40 when the ramp 40 is rotated to the stowed position. Other support equipment 100 may not be rotationally attached to the base skid 50. Therefore, the other support equipment 100 can be lifted by the cables 140, 150 when the ramp 40 is rotated to the stowed position. As used herein, "cable" refers to stranded cable (metal or other materials), linked chain, or any other elongated material that can support tensile loads produced by lifting/lowering the other support equipment 100. The other support equipment 100 can be secured to the base skid 50 or ramp 40 during or after being lifted by the cables 140, 150. The support equipment can include pumps, hoses, equipment skids, valve manifolds, etc. Lifting the support equipment 100 via the cables 140, 150 can raise the support equipment from the ground where it can be resting and secure the support equipment to the base skid 50 or the ramp 40 in preparation for transport of the pipe handling system 10 to another location from the current location (e.g., from a first well site to a second well site).

Figure 4:
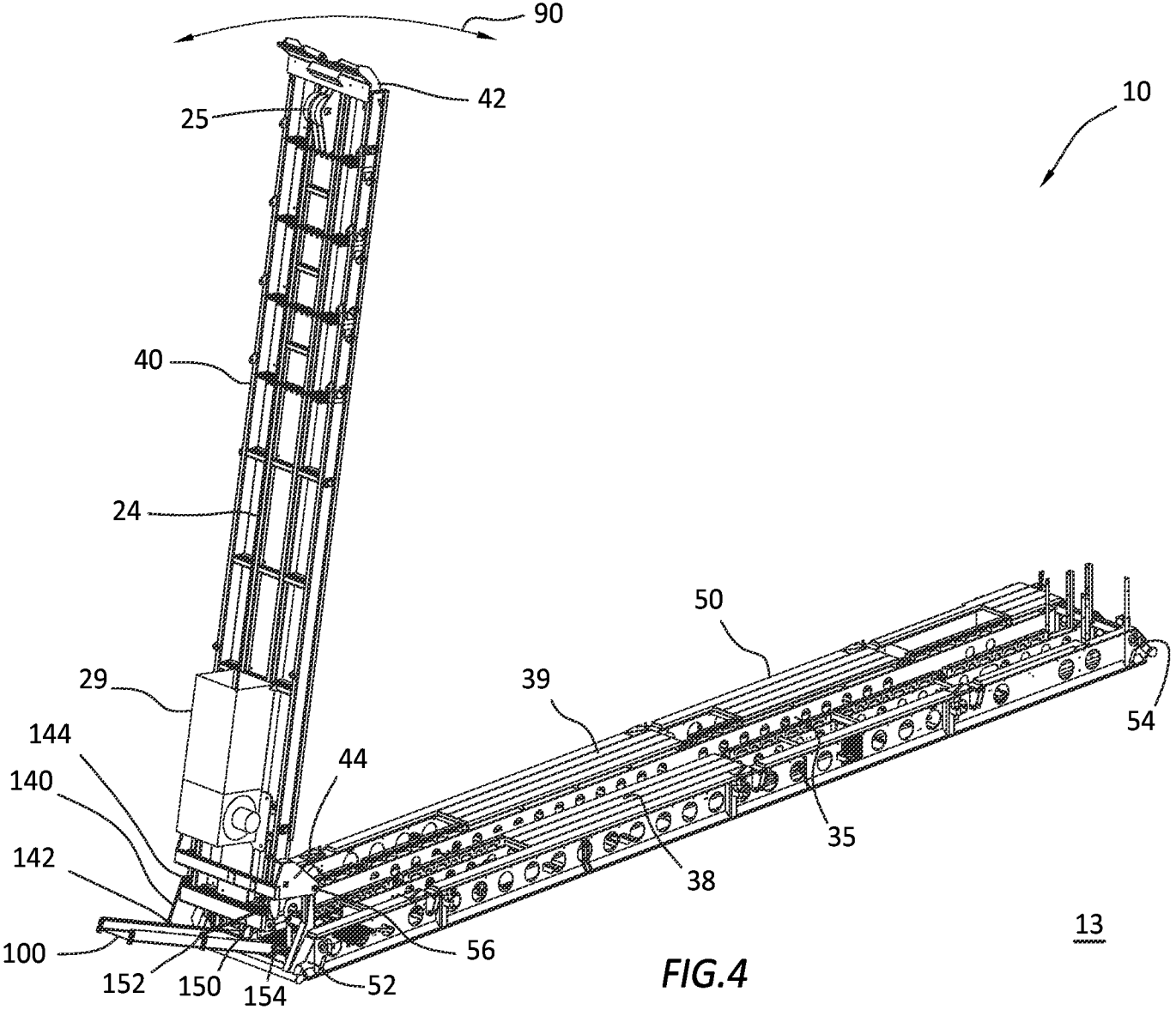
FIG. 4 is a representative perspective view of a pipe handling system being stowed for transport, in accordance with certain embodiments.

FIG. 4 is a representative perspective view of a pipe handling system 10 being stowed for transport by rotating the ramp 40 (arrows 90) about the pivot point 56. As the ramp 40 is rotated into the stowed position, the cables 140, 150 lift the drag chain pan 100 from its deployed position resting on the surface 13 to a stowed position. The cable 140 has an end 142 that can be securely connected to a pad eye on the drag chain pan 100, and an end 144 that can be securely connected to a connection point on the end 44 of the ramp 40. The cable 150 has an end 152 that can be securely connected to a pad eye on the drag chain pan 100, and an end 154 that can be securely connected to a connection point on the end 44 of the ramp 40.

Figure 5:
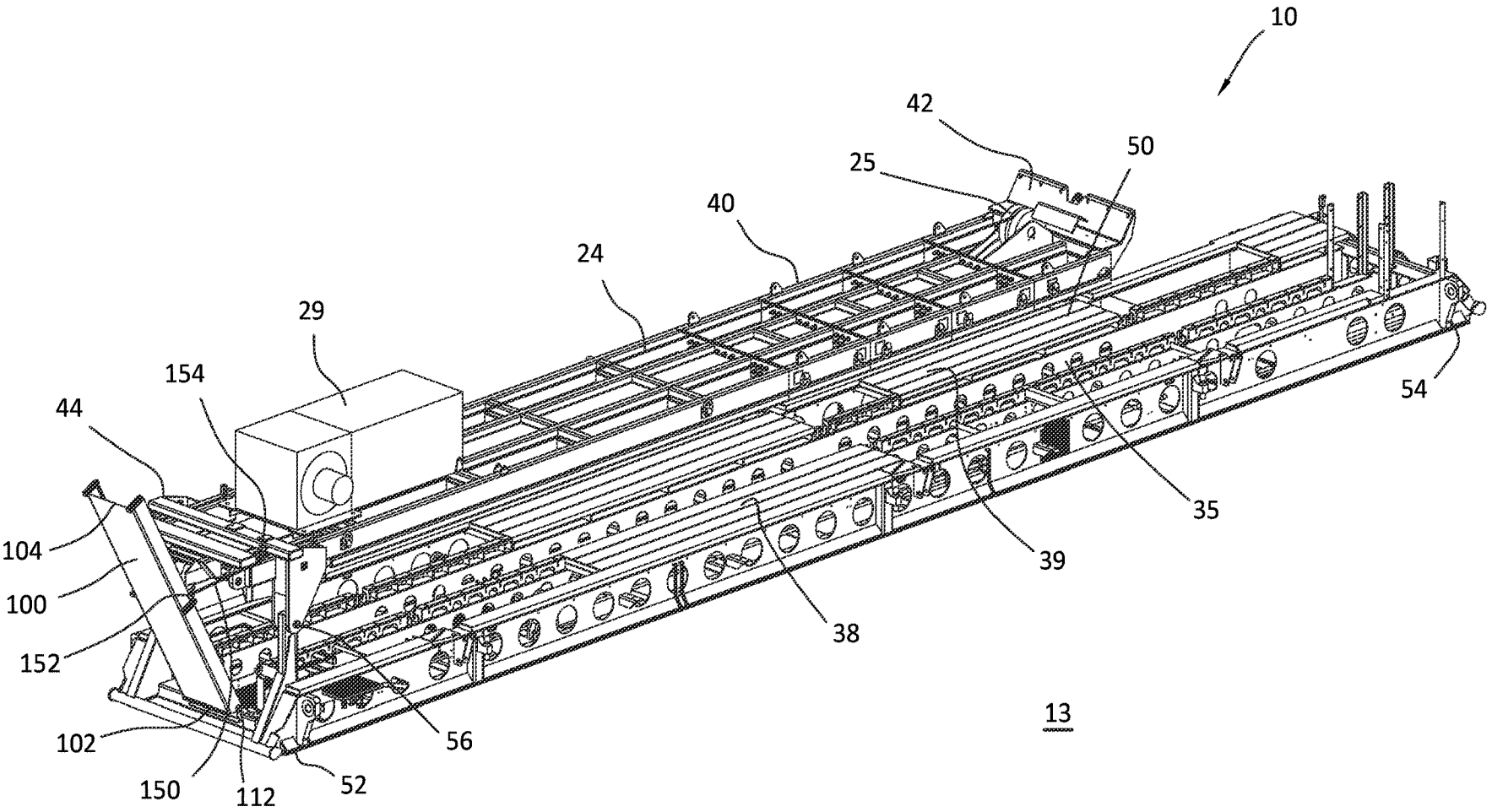
FIG. 5 is a representative perspective view of a pipe handling system stowed for transport, in accordance with certain embodiments.

FIG. 5 is a representative perspective view of a pipe handling system 10 stowed for transport with the ramp 40 resting on the base skid 50. As the ramp 40 is further rotated from position shown in FIG. 4, the drag chain pan 100 can rotate about pivot points 112 at the end 102, and the cables 140, 150 can secure the drag chain pan 100 in its stowed position. Once the drag chain pan 100 is lifted to its stowed position, additional securing connections to the drag chain pan 100 can be made to ensure retention of the drag chain pan 100 in its stowed position, but it is not required that additional securing connections be used to secure the drag chain pan 100 in its stowed position. At least one of the cables 140, 150 can be the only retention features for holding the drag chain pan 100 in its stowed position. It is preferred that both cables 140, 150 are used, but it is not required.

Figure 6:
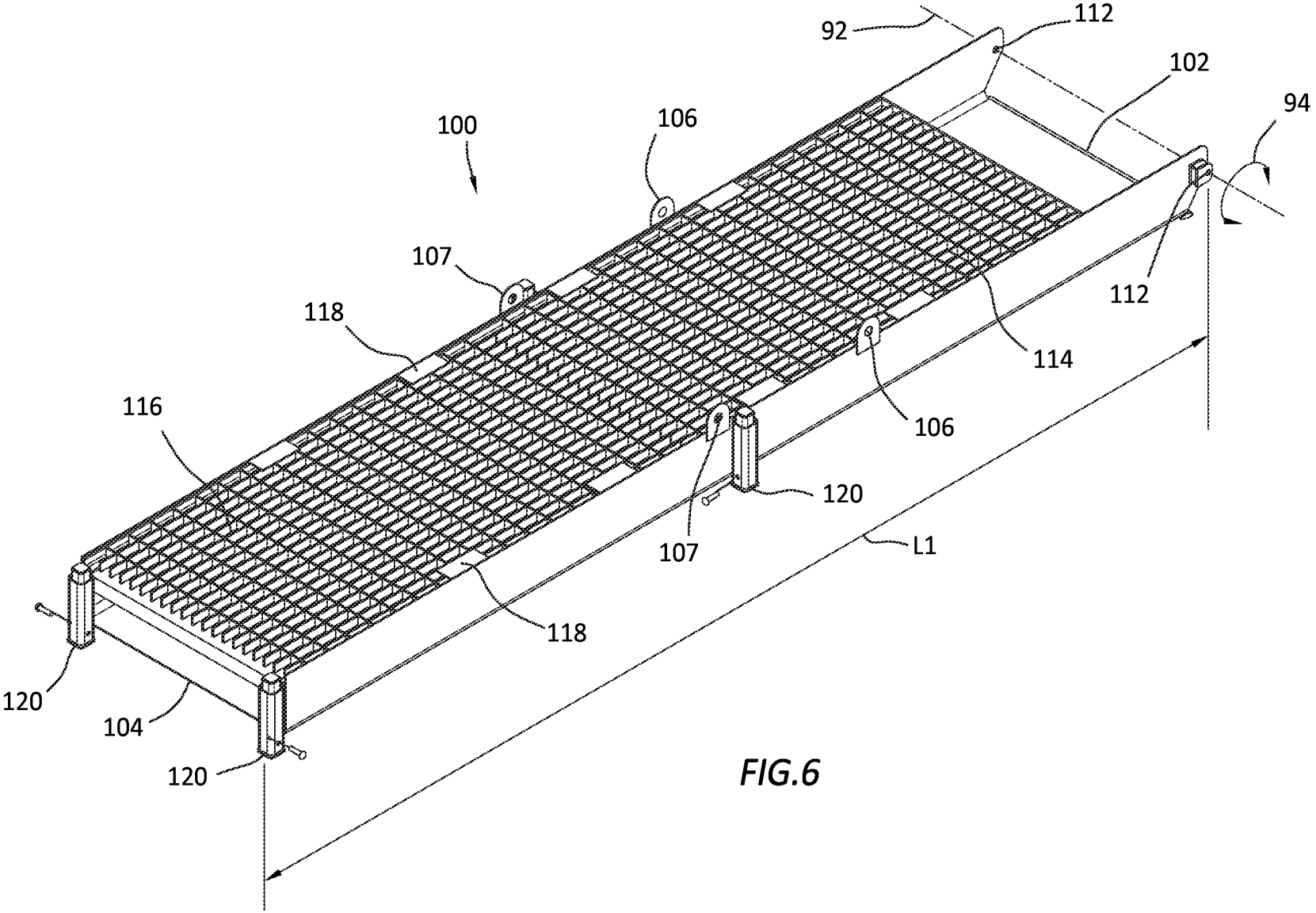
FIG. 6 is a representative perspective view of a drag chain pan, in accordance with certain embodiments.

FIG. 6 is a representative perspective view of a drag chain pan 100, according to the principles of this disclosure. The drag chain pan 100 can include a plurality of extendable feet 120 that can be used to support and align the drag chain pan 100 when the drag chain pan 100 is in its deployed position. Pad eyes 107, 106 can be used to lift and secure the drag chain pan 100 to the ramp 40. The drag chain pan 100 can be rotationally attached to the base skid 50 at the pivot points 112. When the pivot points 112 are attached to the base skid 50, then the drag chain pan 100 can be rotated (arrows 94) about the axis 92. Cover grates 114, 116 can be installed along a channel at the top edge of the drag chain pan 100. Flanges 118 and a support ledge 164 (see FIG. 10) can form a channel 136 on both sides of the drag chain pan 100. Flanges 118 can be used to retain the cover grates 114, 116 in the channel 136 (e.g., during deployment, operation, transport, etc.). The drag chain pan 100 can be a length L1 from the pivot points 112 to the end of the adjustable feet 120 at the end 104.

Figure 7:
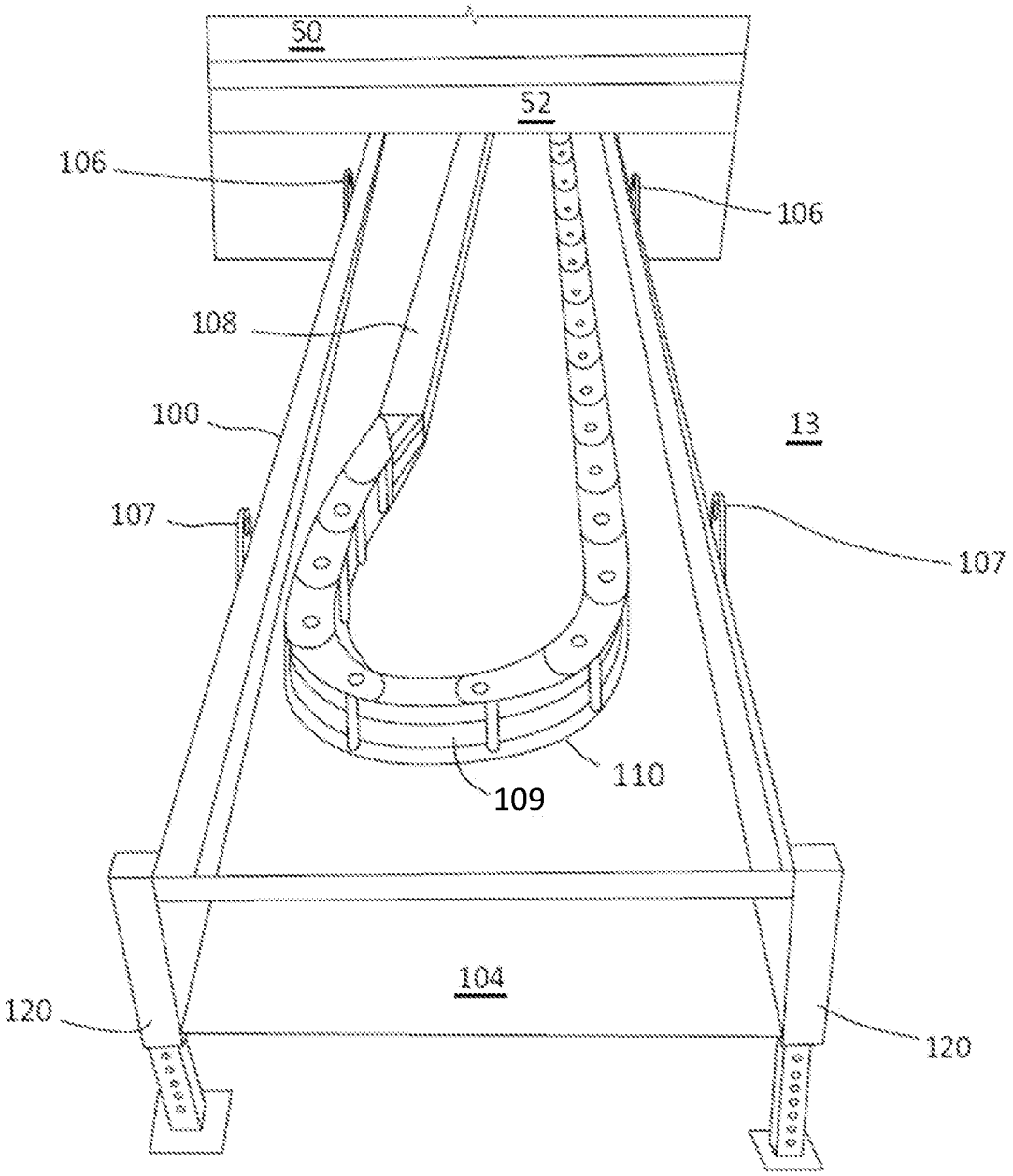
FIG. 7 is a representative perspective view of a drag chain pan in operation, in accordance with certain embodiments.

FIG. 7 is a representative perspective view of a drag chain pan 100 in operation. The drag chain pan 100 is in a deployed position, with the adjustable feet 120 extended to rest the drag chain pan 100 on the ground 13 and align the interior bottom surface of the drag chain pan 100 with the recess 35 in the pipe handling system 10. As stated above, the control and power lines connected to the carrier 22 can have a service loop to accommodate the movement of the carrier 22 in the recess 35. A spear 108 (or transport tubular) can be attached to the end 22*b* of the carrier 22, or the end 36 of the lift arm 30. The spear 108 can be a rigid pipe with a hollow interior (e.g., a square tubing).

The control and power lines 109 can be routed through the interior of the spear 108 and through a drag chain 110 that is connected to an end of the spear 108 and to a location on the base skid 50. The drag chain 110 can include a plurality of rotatable sections that are rotatably connected to each adjacent section which allows the drag chain 110 to protect the control and power lines 109 as the spear 108 is extended into or retracted from the drag chain pan 100. The control and power lines 109 can be routed through an interior of the drag chain 110 with the drag chain 110 providing protection for the control and power lines 109. The drag chain pan 100 provides support for the portion of the drag chain 110 that extend into the drag chain pan 100.

In operation, it is preferred to leave the cover grates 114, 116 installed over the interior of the drag chain pan 100, where the spear 108 and drag chain 110 extend into and retract from the interior of the drag chain pan 100. It is also preferred that these cover grates 114, 116 have a plurality of holes that allow visual inspection of the interior of the drag chain pan 100. Rig operators can determine if the interior of the drag chain pan 100 is clogged with dirt and debris, can schedule maintenance of the drag chain pan 100, can remove the cover grates 114, 116 and clean away the dirt and debris, and can assess the condition of the drag chain 110 over the life of its operation.

Figure 8:
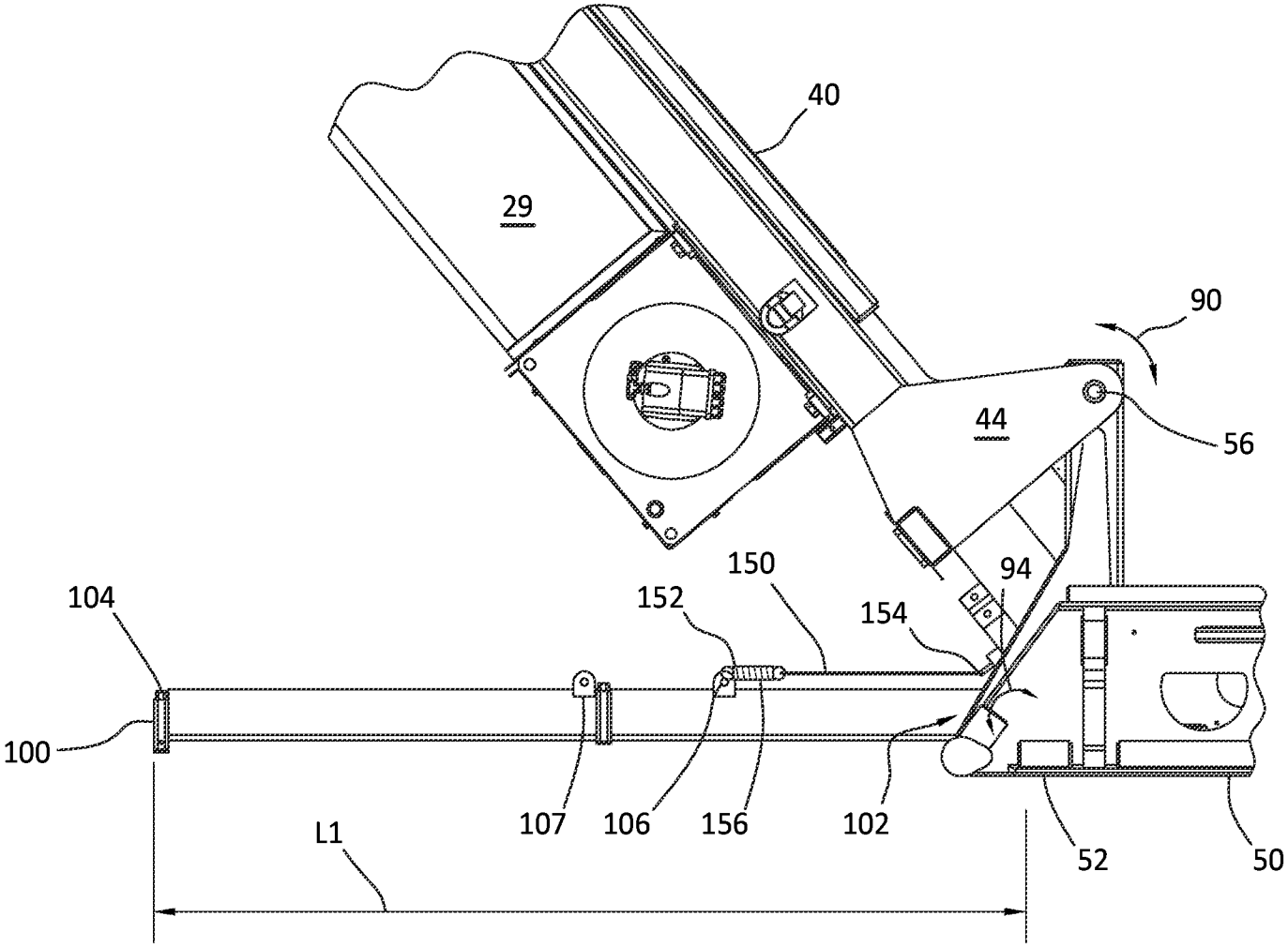
FIG. 8 is a representative detailed side view a pipe handling system with a drag chain pan in the deployed position, in accordance with certain embodiments.

FIG. 8 is a representative detailed side view of a pipe handling system 10 with a drag chain pan 100 in its deployed position. The end 44 of the ramp 40 is pivotably connected to the end 52 of the base skid 50 at the pivot point 56. One cable 150 is shown, but the following discussion is similarly applicable to the other cable 140, as well. The end 152 of the cable 150 can be connected to the drag chain pan 100 at the pad eye 106. The other end 154 of the cable 150 can be connected to a location on the end 44 of the ramp 40. The cable 150 can also include a biasing device 156 that can be positioned at any point between ends 152, 154 including the ends 152, 154. For example, FIG. 8 shows the biasing device 156 at the end 152 of the cable, but the biasing device 156 can be positioned at the end 154 of the cable 150, or at any point in between the ends 152, 154. It should also be understood that the cable 150 itself can be the biasing device, such as if the cable 150 was made of a resilient material or a stretchable cable that increases tension as it is elongated. The cable 150 is shown to be straight between the ends 152, 154 with one bend. However, the cable 150 may have slack to accommodate rotation (arrows 90) of the ramp 40 to the stowed position.

Figure 9:
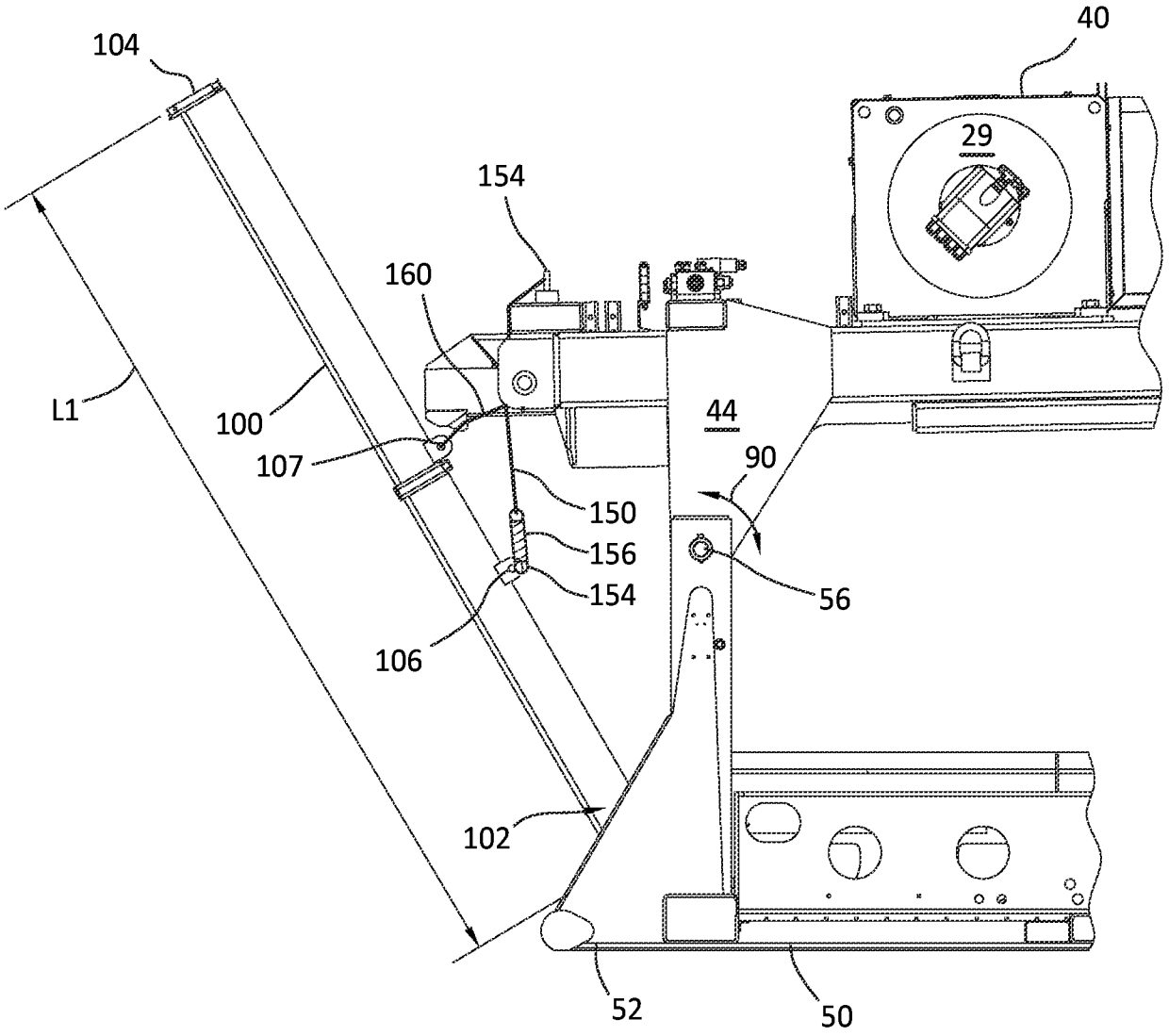
FIG. 9 is a representative detailed side view of an end of a pipe handling system with a drag chain pan in the stowed position, in accordance with certain embodiments.

Referring to FIG. 9, as the ramp 40 is rotated (arrows 90) from the deployed position to the stowed position, the slack in the cable 150 will be taken up until the cable 150 is in tension thereby simultaneously lifting the drag chain pan 100 to its stowed position. As used herein, "simultaneously" refers to the drag chain pan 100 being rotated at the same time that the ramp 40 is being rotated. However, "simultaneously" does not mean that the drag chain pan 100 has to be rotating whenever the ramp 40 is being rotated. The drag chain pan 100 can remain at rest for at least a portion of the time that the ramp 40 is being rotated. "Simultaneously" means that at some point in the rotation of the ramp 40, the drag chain pan 100 is also rotated along with the ramp 40. The length of the cable 150 can be adjusted to cause the biasing device 156 to store up more or less energy.

Therefore, when the ramp 40 is in its stowed position, the biasing device 156 can produce enough tension on the drag chain pan 100 that the cable 150 (along with cable 140) can hold the drag chain pan 100 in its stowed position. The cable 150 (along with cable 140) can provide enough tension on the pad eye 106 to hold the drag chain pan 100 in its stowed position as the pipe handling system 10 is being transported. However, a secondary restraint can be used to provide additional assurance that the drag chain pan 100 will remain in its stowed position while the pipe handling system 10 is being transported to a new well site. For example, a retention feature 160 can be used to connect the drag chain pan 100 to the end 44 of the ramp 40, when the drag chain pan 100 is lifted to its stowed position. The retention feature 160 can be connected to the drag chain pan 100, such as via a pad eye 107. The retention feature 160 can be a chain, cable, rigid support member, strap, come along, etc. However, it should be understood that the retention feature 160 is not required. One of the cables 140, 150 can be sufficient to secure the drag chain pan 100 in its stowed position during transport.

As can be seen in FIGS. 8, 9, the drag chain pan 100 of length L1 remains extended at the length L1 whether it is in the deployed position (FIG. 8) or the stowed position (FIG. 9). Other drag chain pans are folded up before being lifted to a stowed position by lifting equipment (e.g., forklift), thereby reducing an extended distance of the drag chain pan from the deployed position to the stowed position. However, one of the novel aspects of this disclosure is that the drag chain pan 100 is not folded before securing the drag chain pan 100 in the stowed position. Therefore, the length of the drag chain pan 100 from the pivots 112, to the end of the adjustable feet 120 at the end 104 remains the same in either of the deployed or stowed positions.

Figure 10:
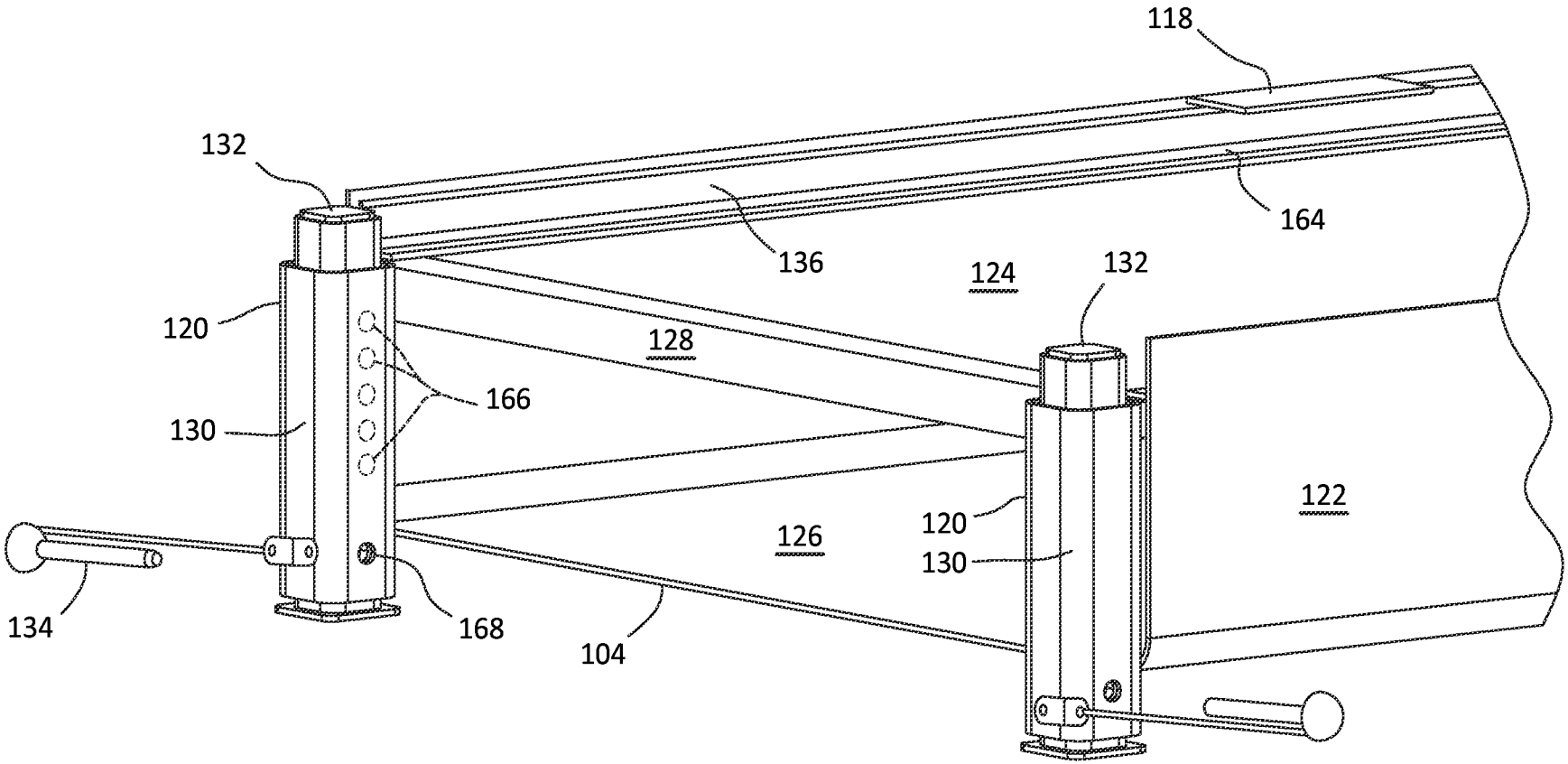
FIG. 10 is a representative detailed perspective view of an end of a drag chain pan, in accordance with certain embodiments.

FIG. 10 is a representative detailed perspective view of the end 104 of the drag chain pan 100. The drag chain pan 100 can include a generally U-shaped body with a bottom 126 positioned between two sides 122, 124. Each side 122, 124 can have a channel 136 positioned at the top of each side 122, 124, with the channel 136 of each channel 136 facing each other. The cover grates 114, 116 can be installed in the channels 136 that are formed by the flanges 118 and the structural support 164. A support 128 can be installed between the two sides 122, 124 to improve structural integrity of the drag chain pan 100. Each adjustable foot 120 can include a sleeve 130 and an insert 132. The sleeve 130 can be rigidly attached to the drag chain pan 100, and the sleeve 130 can include an alignment hole 168.

The sleeve 132 can be inserted into the sleeve 130. When the alignment hole 168 of the sleeve 130 aligns with one of a plurality of adjustment holes 166, the retainer 134 can be inserted through the alignment hole 168 and the adjustment hole 166 that aligns with the alignment hole 168. This can be used to adjust the height of the adjustable foot 120 when the drag chain pan 100 is deployed. However, the adjustable foot 120 can also be used to keep the cover grates 114, 116 from sliding out of the channels 136 by extending above the sleeve 130 a desired amount. When it is desired to stow the drag chain pan 100 and move the pipe handling system 10 to a new well site, the insert 132 can be inserted into the sleeve 130 until the top of the sleeve 132 extends above the sleeve 130 to a blocking position at the end of the channel 136. When in this stowed position, the retainer 134 can be inserted through the alignment hole 128 of the sleeve 130 and through the bottom adjustment hole 126. This will retain the insert 132 in its stowed position until an operator removes the retainer 134 at the new well site (or whenever the operator wishes to remove it).

Figure 11:
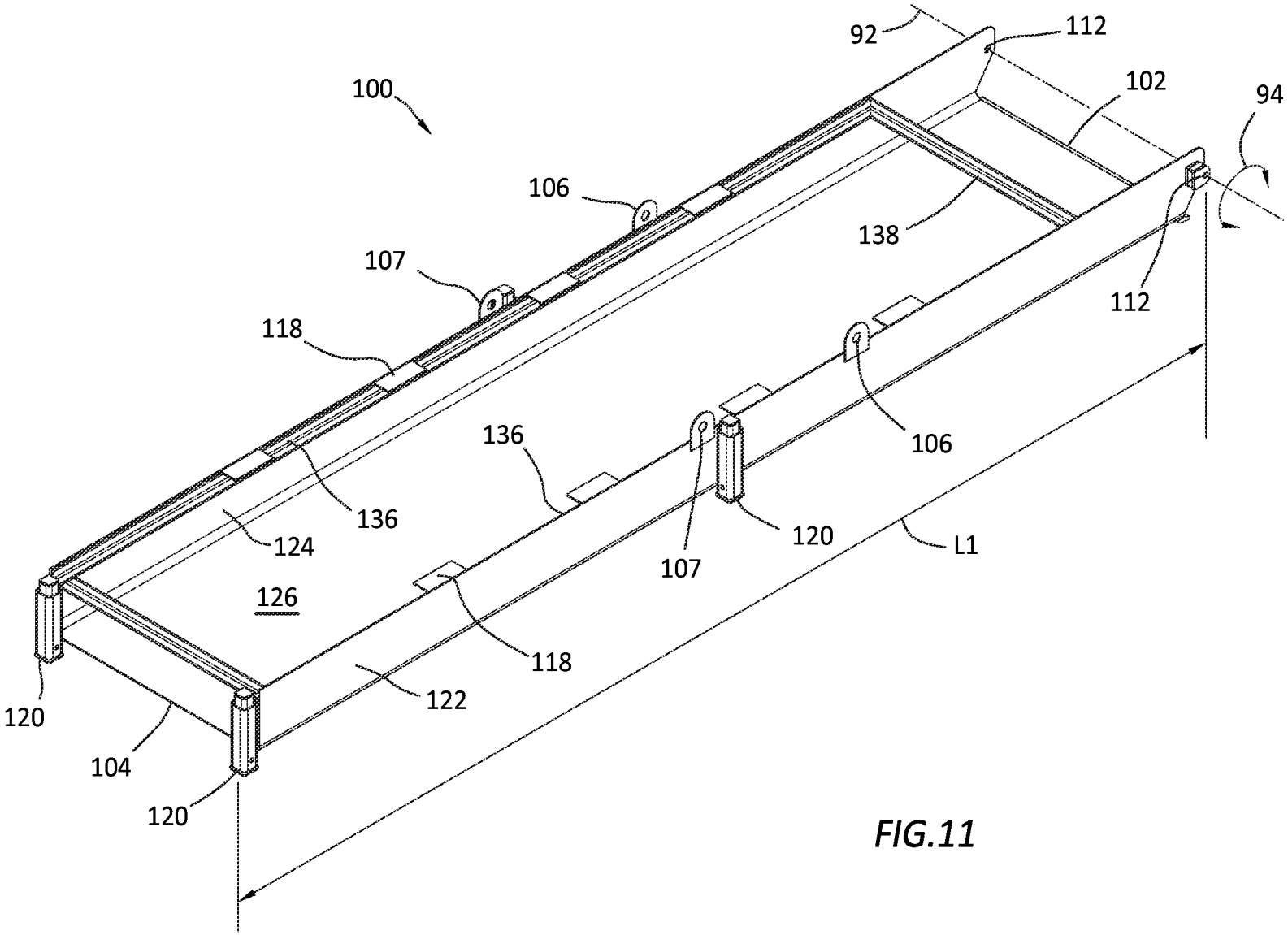
FIG. 11 is a representative perspective view of a drag chain pan without cover grates, in accordance with certain embodiments.

FIG. 11 is a representative perspective view of the drag chain pan 100 without cover grates 114, 116. The cover grates 114, 116 can be installed in the channels 136 of the sides 122, 124. A support 138 with a channel that is aligned with the channels 136 can be installed proximate the end 102 of the drag chain pan 100 to provide a stop when the cover grates 114, 116 are installed in the channels 136.

Various Embodiments

Embodiment 1. A system for conducting subterranean operations comprising:

a pipe handling system configured to transport tubulars between a horizontal storage location and a rig floor of a rig, the pipe handling system comprising:

a base skid;

a ramp rotationally attached to the base skid; and support equipment positioned proximate the rotational attachment of the ramp to the base skid, wherein rotation of the ramp from a first deployed position to a first stowed position lifts the support equipment from a second deployed position to a second stowed position.

Embodiment 2. The system of embodiment 1, wherein rotation of the ramp from the first stowed position to the first deployed position lowers the support equipment from the second stowed position to the second deployed position.

Embodiment 3. The system of embodiment 1, wherein at least one cable couples the support equipment to the ramp, and wherein the at least one cable lifts the drag chain pan to the second stowed position when the ramp is rotated to the first stowed position.

Embodiment 4. The system of embodiment 3, wherein the at least one cable comprises a biasing device, such that lifting the support equipment to the second stowed position compresses the biasing device and increases tension in the at least one cable.

Embodiment 5. The system of embodiment 4, wherein increased tension in the at least one cable acts between the ramp and the support equipment to retain the support equipment in the second stowed position.

Embodiment 6. The system of embodiment 3, wherein one or more retention features are coupled between the support equipment and the ramp to retain the support equipment in the second stowed position.

Embodiment 7. A system for conducting subterranean operations comprising:

a pipe handling system configured to transport tubulars between a horizontal storage location and a rig floor of a rig, the pipe handling system comprising:

a base skid;

a ramp rotationally attached to the base skid; and a drag chain pan rotationally attached to the base skid at pivot points and the drag chain pan coupled to the ramp, wherein rotation of the ramp from a first deployed position to a first stowed position rotates the drag chain pan from a second deployed position to a second stowed position.

Embodiment 8. The system of embodiment 7, wherein rotation of the ramp from the first stowed position to the first deployed position rotates the drag chain pan from the second stowed position to the second deployed position.

Embodiment 9. The system of embodiment 7, wherein at least one cable couples the drag chain pan to the ramp, and wherein the at least one cable lifts the drag chain pan to the second stowed position when the ramp is rotated to the first stowed position.

Embodiment 10. The system of embodiment 9, wherein the at least one cable comprises a biasing device, such that rotating the drag chain pan to the second stowed position compresses the biasing device and increases tension in the at least one cable.

Embodiment 11. The system of embodiment 10, wherein increased tension in the at least one cable acts between the ramp and the drag chain pan to retain the drag chain pan in the second stowed position.

Embodiment 12. The system of embodiment 9, wherein a retention feature is coupled between the drag chain pan and the ramp to retain the drag chain pan in the second stowed position.

Embodiment 13. The system of embodiment 7, further comprising:

a tubular carrier configured to be pulled up the ramp from the base skid and lowered down the ramp to the base skid;

a drag chain coupled to the tubular carrier; and the drag chain pan being configured to receive the drag chain.

Embodiment 14. The system of embodiment 13, wherein the drag chain has control and power lines routed therethrough, and wherein the control and power lines are coupled between the tubular carrier and the base skid.

Embodiment 15. The system of embodiment 7, wherein a longitudinal length of the drag chain pan from the pivot points to an opposite end of the drag chain pan is substantially the same when the drag chain pan is in the second stowed position or in the second deployed position.

Embodiment 16. The system of embodiment 15, wherein the second stowed position is a position of the drag chain pan when the pipe handling system is being transported from one well site to another well site.

Embodiment 17. The system of embodiment 7, wherein the drag chain pan comprises a plurality of adjustable feet.

Embodiment 18. The system of embodiment 17, wherein each of the plurality of adjustable feet can be extended at various lengths toward a ground surface to support the drag chain pan against the ground surface when the drag chain pan is in the second deployed position.

Embodiment 19. The system of embodiment 17, wherein the drag chain pan further comprises a U-shaped body with first and second sides and a bottom, wherein a channel is disposed at a top of each of the first side and the second side, and wherein cover grates are installed along the channel.

Embodiment 20. The system of embodiment 19, wherein at least one of the plurality of adjustable feet is adjusted to prevent removal of the cover grates from the channel, when the drag chain pan in the second stowed position.

Embodiment 21. A method for conducting subterranean operations comprising:

moving a pipe handling system, the pipe handling system comprising a ramp rotationally attached to a base skid, and a drag chain pan rotationally attached to the base skid;

rotating the ramp relative to the base skid from a first deployed position to a first stowed position; and simultaneously rotating the drag chain pan relative to the base skid from a second deployed position to a second stowed position in response to rotating the ramp from the first deployed position to the first stowed position.

Embodiment 22. The method of embodiment 21, further comprising:

moving the pipe handling system from a first location to a second location with the ramp in the first stowed position and the drag chain pan in the second stowed position.

Embodiment 23. The method of embodiment 22, further comprising:

at the second location, rotating the ramp relative to the base skid from the first stowed position to the first deployed position; and at the second location, simultaneously rotating the drag chain pan relative to the base skid from the second stowed position to the second deployed position in response to rotating the ramp from the first stowed position to the first deployed position.

Embodiment 24. The method of embodiment 21, further comprising:

coupling, via at least one cable, the ramp to the drag chain pan; and lifting, via the at least one cable, the drag chain pan from the second deployed position to the second stowed position in response to rotating the ramp from the first deployed position to the first stowed position.

Embodiment 25. The method of embodiment 24, wherein the at least one cable comprises a biasing device, and wherein rotating the ramp to the first stowed position rotates the drag chain to the second stowed position and compresses the biasing device.

Embodiment 26. The method of embodiment 25, further comprising increasing a tension force in the at least one cable in response to compressing the biasing device.

While the present disclosure may be susceptible to various modifications and alternative forms, specific embodiments have been shown by way of example in the drawings and tables and have been described in detail herein. However, it should be understood that the embodiments are not intended to be limited to the particular forms disclosed. Rather, the disclosure is to cover all modifications, equivalents, and alternatives falling within the spirit and scope of the disclosure as defined by the following appended claims. Further, although individual embodiments are discussed herein, the disclosure is intended to cover all combinations of these embodiments.

The invention claimed is:

1. A system for conducting subterranean operations comprising:

a pipe handling system configured to transport tubulars between a horizontal storage location and a rig floor of a rig, the pipe handling system comprising:

a base skid;

a ramp rotationally attached to the base skid at a first pivot point; and support equipment rotationally attached to the base skid at a second pivot point, wherein the first pivot point is spaced away from the second pivot point, wherein the support equipment is positioned proximate the rotational attachment of the ramp to the base skid, and wherein rotation of the ramp from a first deployed position to a first stowed position lifts the support equipment from a second deployed position to a second stowed position.

2. The system of claim 1, wherein rotation of the ramp from the first stowed position to the first deployed position lowers the support equipment from the second stowed position to the second deployed position.

3. The system of claim 1, wherein at least one cable couples the support equipment to the ramp, and wherein the at least one cable lifts the support equipment to the second stowed position when the ramp is rotated to the first stowed position.

4. The system of claim 3, wherein the at least one cable comprises a biasing device, such that lifting the support equipment to the second stowed position compresses the biasing device and increases tension in the at least one cable.

5. The system of claim 4, wherein increased tension in the at least one cable acts between the ramp and the support equipment to retain the support equipment in the second stowed position.

6. The system of claim 3, wherein one or more retention features are coupled between the support equipment and the ramp to retain the support equipment in the second stowed position.

7. A system for conducting subterranean operations comprising:

a pipe handling system configured to transport tubulars between a horizontal storage location and a rig floor of a rig, the pipe handling system comprising:

a base skid;

a ramp rotationally attached to the base skid; and support equipment positioned proximate the rotational attachment of the ramp to the base skid, wherein rotation of the ramp from a first deployed position to a first stowed position lifts the support equipment from a second deployed position to a second stowed position, and wherein the support equipment comprises a drag chain pan, and wherein the drag chain pan is rotationally attached to the base skid at pivot points and the drag chain pan is coupled to the ramp.

8. The system of claim 7, further comprising:

a tubular carrier configured to be pulled up the ramp from the base skid and lowered down the ramp to the base skid;

a drag chain coupled to the tubular carrier; and the drag chain pan being configured to receive the drag chain.

9. The system of claim 8, wherein the drag chain has control and power lines routed therethrough, and wherein the control and power lines are coupled between the tubular carrier and the base skid.

10. The system of claim 7, wherein a longitudinal length of the drag chain pan from the pivot points to an opposite end of the drag chain pan is substantially the same when the drag chain pan is in the second stowed position or in the second deployed position.

11. The system of claim 10, wherein the second stowed position is a position of the drag chain pan when the pipe handling system is being transported from one well site to another well site.

12. The system of claim 7, wherein the drag chain pan comprises a plurality of adjustable feet, and wherein each of the plurality of adjustable feet can be extended at various lengths toward a ground surface to support the drag chain pan against the ground surface when the drag chain pan is in the second deployed position.

13. The system of claim 7, wherein the drag chain pan comprises a plurality of adjustable feet, and wherein the drag chain pan further comprises a U-shaped body with first and second sides and a bottom, wherein a channel is disposed at a top of each of the first side and the second side, and wherein cover grates are installed along the channel.

14. The system of claim 13, wherein at least one of the plurality of adjustable feet is adjusted to prevent removal of the cover grates from the channel, when the drag chain pan in the second stowed position.

15. A method for conducting subterranean operations comprising:

moving a pipe handling system, the pipe handling system comprising a ramp rotationally attached to a base skid, and a drag chain pan rotationally attached to the base skid;

rotating the ramp relative to the base skid from a first deployed position to a first stowed position; and simultaneously rotating the drag chain pan relative to the base skid from a second deployed position to a second stowed position in response to rotating the ramp from the first deployed position to the first stowed position.

16. The method of claim 15, further comprising:

moving the pipe handling system from a first location to a second location with the ramp in the first stowed position and the drag chain pan in the second stowed position.

17. The method of claim 16, further comprising:

at the second location, rotating the ramp relative to the base skid from the first stowed position to the first deployed position; and at the second location, simultaneously rotating the drag chain pan relative to the base skid from the second stowed position to the second deployed position in response to rotating the ramp from the first stowed position to the first deployed position.

18. The method of claim 15, further comprising:

coupling, via at least one cable, the ramp to the drag chain pan; and lifting, via the at least one cable, the drag chain pan from the second deployed position to the second stowed position in response to rotating the ramp from the first deployed position to the first stowed position.

19. The method of claim 18, wherein the at least one cable comprises a biasing device, and wherein rotating the ramp to the first stowed position rotates the drag chain to the second stowed position and compresses the biasing device.

20. The method of claim 19, further comprising increasing a tension force in the at least one cable in response to compressing the biasing device.

* * * * *